US008440025B2

(12) United States Patent
Christmann et al.

(10) Patent No.: US 8,440,025 B2
(45) Date of Patent: May 14, 2013

(54) WATER-CONDUCTING DOMESTIC APPLIANCE

(75) Inventors: Jens Christmann, Heidenheim (DE); Reinhard Hering, Holzheim (DE); Michael Rosenbauer, Reimlingen (DE); Franz-Josef Wagner, Nördlingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 391 days.

(21) Appl. No.: 12/674,718

(22) PCT Filed: Aug. 22, 2008

(86) PCT No.: PCT/EP2008/061025

§ 371 (c)(1),
(2), (4) Date: Feb. 23, 2010

(87) PCT Pub. No.: WO2009/027341

PCT Pub. Date: Mar. 5, 2009

(65) Prior Publication Data

US 2011/0155176 A1 Jun. 30, 2011

(30) Foreign Application Priority Data

Aug. 31, 2007 (DE) ..... 10 2007 041 310

(51) Int. Cl.
*A47L 15/42* (2006.01)
*B08B 3/00* (2006.01)
*D06F 33/00* (2006.01)

(52) U.S. Cl.
USPC ..... 134/18; 134/56 D; 134/58 D; 134/113

(58) Field of Classification Search ..... 134/18, 134/56 D, 56 R, 57 D, 58 D, 113; 68/3 R, 68/12.01, 12.05, 12.17, 12.21, 12.27
See application file for complete search history.

(56) References Cited

U.S. PATENT DOCUMENTS 2,526,444 A * 10/1950 Woodson ..... 68/12.01
2,752,769 A * 7/1956 Clark ..... 68/12.19
3,552,156 A * 1/1971 Toulemonde et al. ..... 68/12.05
3,986,372 A * 10/1976 Karklys ..... 68/12.21
4,069,425 A 1/1978 Cushing (Continued)

FOREIGN PATENT DOCUMENTS

CA 1136247 11/1982
CN 2711485 Y 7/2005

(Continued)

OTHER PUBLICATIONS

Machine Translation of JP 05031287 to Suzuki et al., Feb. 1993.*

(Continued)

*Primary Examiner* — Michael Barr
*Assistant Examiner* — Benjamin L Osterhout
(74) *Attorney, Agent, or Firm* — James E. Howard; Andre Pallapies

(57) ABSTRACT

A water-conducting domestic appliance having a drain pump, a controller to activate the drain pump, and a water safety switch that has a first switch position to react to escaping water, wherein the water safety switch is connected to the controller. If a fault causes water to escape, the water safety switch switches into the first switch position so as to connect the controller to an electrical mains.

15 Claims, 1 Drawing Sheet

U.S. PATENT DOCUMENTS

| | | | | | |
|---|---|---|---|---|---|
| 4,180,088 | A | * | 12/1979 | Mallett | 137/87.03 |
| 4,305,420 | A | * | 12/1981 | Nussdorf | 137/312 |
| 5,168,885 | A | * | 12/1992 | Tromblee et al. | 134/105 |

FOREIGN PATENT DOCUMENTS

| | | | | |
|---|---|---|---|---|
| DE | 3538604 | A1 | | 5/1987 |
| DE | 3544307 | A1 | | 6/1987 |
| DE | 8523674 | U1 | | 10/1987 |
| DE | 4209582 | A1 | | 9/1993 |
| DE | 19809114 | C1 | | 6/1999 |
| DE | 4402975 | B4 | | 5/2004 |
| JP | 05031287 | A | * | 2/1993 |
| WO | 2008017911 | A1 | | 2/2008 |

OTHER PUBLICATIONS

Report of Examination CN 200880104690.8 to Christmann et al., Jun. 16, 2011.

* cited by examiner

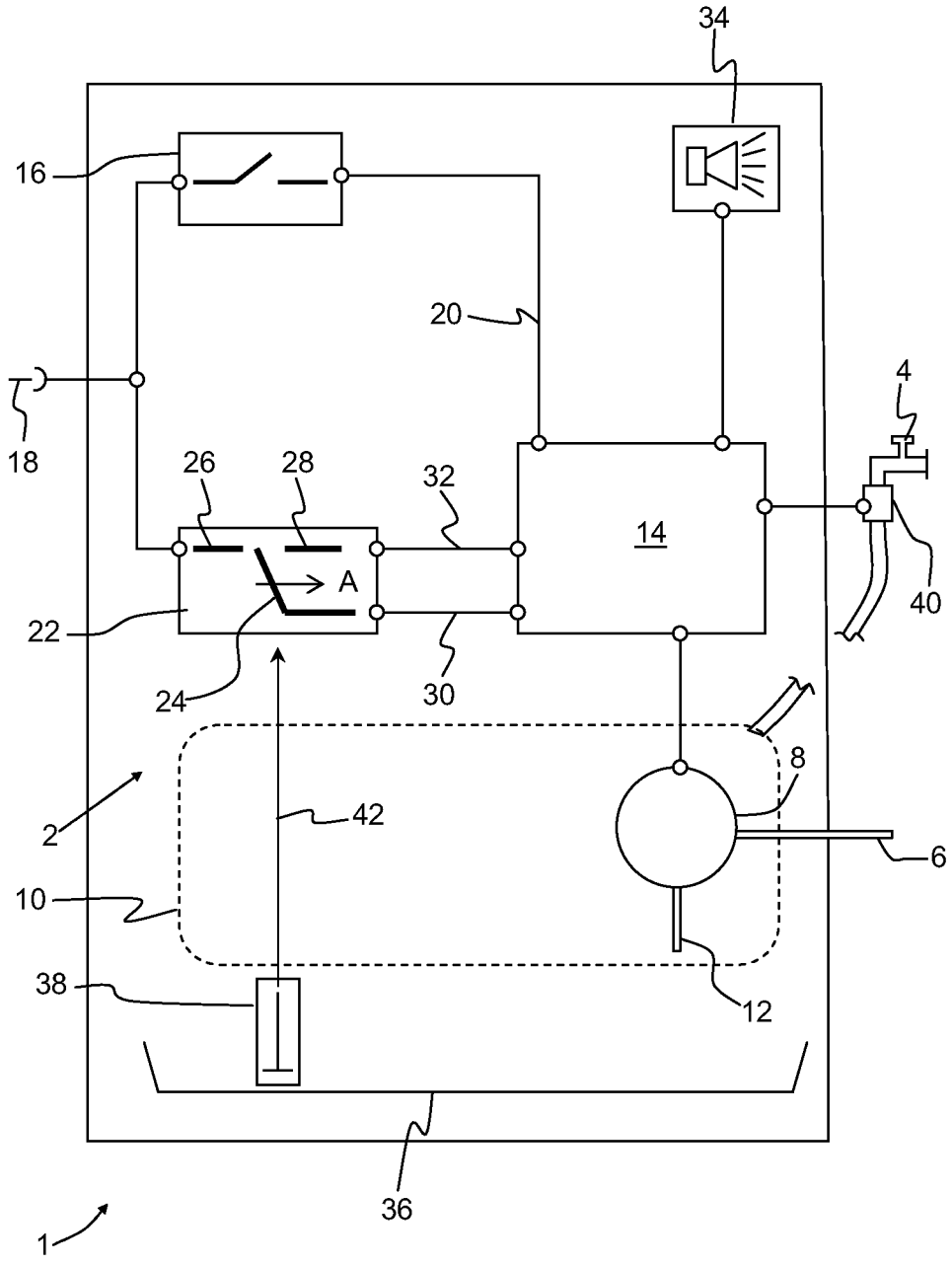
34
16
20
4
18
26
28
32
14
A
40
22
24
30
8
2
42
6
10
38
12
36
1

WATER-CONDUCTING DOMESTIC APPLIANCE

BACKGROUND OF THE INVENTION

The invention relates to a water-conducting domestic appliance.

To prevent damage during operation of water-conducting domestic appliances, especially dishwashers and washing machines, caused by the unwanted escape of water, it is known from the prior art that the water supply can be interrupted by closing water inlet valves if the device starts to leak.

To prevent water from escaping from the domestic appliance if the water inlet valves do not close completely and to improve the water safety of switched-off domestic appliances, especially of dishwashers and washing machines, a water safety device is known from DE 35 44 307 A1 in which, if a fault causes water to escape while the device is switched off, a drain pump is automatically activated.

The safety device in this case comprises a main switch, a water cutoff switch and also a controller for activating a drain pump. The main switch and the water cutoff switch are each assigned a connection to the electrical mains, with the water cutoff switch able to be switched by a float.

When the main switch is closed, the drain pump is controlled during normal operation of the domestic appliance by control electronics.

In the event of a leak the water cutoff switch overrides the main switch of the domestic appliance and connects the drain pump directly to the electrical mains. The drain pump is thus activated independently of the position of the main switch directly by the water cutoff switch. After an activation of the drain pump by the water cutoff switch the problem arises of a defect in the water cutoff switch meaning that the drain pump is in operation without interruption and runs the risk of overheating.

A safety circuit for water-conducting domestic appliances, especially washing machines and dishwashers, is known from DE 198 09 114 C1, which features an additional logic circuit supplied permanently from the mains voltage, one of the functions of which is to connect a process controller to the power supply on the detection of a leakage, with the process controller then initiating predetermined switching processes via components such as pumps for example of the domestic appliance as a function of the activation conditions obtaining However standby power losses occur as a result of the permanent supply of mains voltage to the logic circuit.

BRIEF SUMMARY OF THE INVENTION

Accordingly an object of the invention is to further improve the water and device safety of water-conducting domestic appliances when the device is switched off.

This object is inventively achieved by provision being made for the water safety switch to have a connection to the controller. In such cases this can involve an electrically-conducting connection in the case of a float switch. Alternately the water safety switch might involve an optical fiber embodied as an immersion bar which is connected to the controller for optical conduction. If there is an unwanted escape of water the water safety switch switches into the first switching position and connects the controller to the electrical mains. Subsequently the controller initiates the required control steps in order to prevent an escape of water and the water damage associated therewith. It switches on the drain pump. The required control steps can be stored in the controller as a program. Even if the domestic appliance is switched off the water safety of the domestic appliance is consequently guaranteed without standby losses. By activating the drain pump via the controller there is the option of controlling the displacement of the drain pump so that it cannot overheat or run under dry conditions.

Preferably there is provision in this case for the controller to be connected to a main switch of the water-conducting domestic appliance. This connection can be embodied to conduct electricity and thus allows, with an appropriately embodied controller, switch-on signals of the main switch to be ignored even if the water safety switch is switched on as result of a fault involving escaping water. In this case there is preferably provision for the main switch, in the switched-on state, to connect the controller to the electrical mains, i.e. for the main switch to switch on the mains power. However there can also be provision for the main switch to be connected to the controller and for the controller to be connected directly to the mains voltage, with the controller having a switched-mode transformer which is activated by the main switch for transforming the mains voltage.

Finally there can be provision for the main switch and the water safety switch to be electrically connected by one terminal to an electrical mains and thus form a parallel circuit.

In a preferred embodiment there is provision for the water safety switch to be embodied with self-diagnosis capabilities so that it can be checked for functional integrity and, if a functional fault is present, a corresponding signal can be generated.

In this case, in an advantageous embodiment of the invention, the water safety switch can feature a first contact assigned to the first switch position, a second contact assigned to a second switch position and also a switching elements able to be switched between these two contacts or switch positions. The switching element in this case is connected to the controller via a first terminal. The first contact has a connection to the electrical mains. The second contact is electrically connected via a second terminal to the controller. In the first switch position the switching element connects the electrical mains to the controller, in the second switching position the first terminal of the controller is connected to the second terminal of the controller.

Thus, when the main switch is switched on, the controller can recognize the switch position in which the water safety switch is set. Provided for example the water safety switch is not in the second switch position when the main switch is switched on, the controller can determine either a defect of a water safety switch or an escape of water caused by a fault in this way, with the water safety switch for the latter case however having to be set to the first switch position. The controller can thus diagnose the switch position of the water safety switch, whereby the device safety of the domestic appliance in the switched-on state is further improved To switch the water safety switch both in the idle state and also during operation of the domestic appliance into the second switch position, the water safety switch in accordance with a further embodiment can include a reset means. It can be embodied as a spring or magnet and be assigned to the switching element and switch it into the second switch position. This enables the water safety switch, after having been switched as a result of a leak into the first switch position, to be switched back into the second switch position and thereby the electrical connection of the controller to the electrical mains to be interrupted when the main switch is switched off. In addition a chance switching of the water safety switch into the first switch position, for example as a result of mechanical vibrations, can be excluded In accordance with a further inventive embodiment the safety device features a warning device which is electrically connected to the controller. The controller activates the warning device as soon as the water safety switch is in its first switch position. The signaling device can for example involve an acoustic and/or optical signal device which, on activation by the controller, generates an alarm tone or a light signal respectively. It signals to the user of the domestic appliance that a malfunction has occurred.

Electromagnetically-controlled inlet valves for domestic appliances are known from the prior art which have water inlet valves that prevent the inflow of water into the domestic appliance when no power is applied to them. For further improving the water safety the water connection of the domestic appliance in accordance with the invention can have an electromagnetically-controlled inlet valve which is connected via an electrical line to the controller. The inlet valve is controlled by the controller and has no current supplied to it in the first switch position of the water safety switch and is thus closed. In the event of a leak in the domestic appliance the further inflow of water into the domestic appliance can thus be suppressed in an advantageous manner.

To receive water escaping accidentally spillage containers are known which for example involve troughs arranged below the water-conducting components. A float can be arranged in such a spillage container which floats when the spillage container fills with water. According to a further embodiment of the invention the float is coupled to the water safety switch such that when it starts to float it switches the water safety switch into the first switch position and thereby connects the controller to the electrical mains, i.e. activates it.

The object stated at the start is also achieved by the water safety switch of the water-conducting domestic appliance being checked and, on detection of incorrect escape of water, the domestic appliance being controlled in a specified manner in accordance with the program. Provided the controller detects that the water safety switch is not set to the first switch position, the domestic appliance is activated by the controller according to specification, for example in accordance with a washing program selected. The first switch position on the other hand typically causes the controller to pump out water or to signal a defect. The inventive checking of the switch position of the water safety switch thus represents a self-diagnosis of the safety device, with the controller being able to execute the required program steps in the event of a defect, for example activating a signaling device or a drain pump.

Preferably there is provision in this case for the water safety switch to be monitored independently of its switch state, i.e. independently of whether the water-conducting domestic appliance is switched on or switched off.

Furthermore there is preferably provision for the water safety switch to be checked continuously or at intervals for functional integrity. For example the water safety switch can be checked each time the appliance is switched on and/or switched off or independently thereof, i.e. independently of whether the water-conducting appliance is switched on or switched off. This can be done continuously or at intervals.

In accordance with one embodiment of the inventive method, in the first switch position of the water safety switch, the drain pump for pumping out escaped water can be activated independently of the switch position of the main switch. This means that both in the switched-off and also the switched-on state water escaping accidentally can be pumped away.

To avoid overheating of the drain pump during ongoing operation as a result of non-interrupting escape of water, the drain pump can be operated in accordance with a further embodiment of the invention with timed interruptions, i.e. at intervals for example.

BRIEF DESCRIPTION OF THE DRAWINGS

The principle of the invention is described in greater detail below with examples which refer to the drawing. In the drawing the single FIG. 1 shows an exemplary embodiment of the inventive water-conducting domestic appliance.

DETAILED DESCRIPTION OF EXEMPLARY EMBODIMENTS OF THE PRESENT INVENTION

The domestic appliance 1 involves a dishwasher having a water connection 4 with an electromagnetic inlet valve 40 for the supply of fresh water into a washing compartment 10. A drain pump or discharge pump 8 is provided for pumping out used or no longer needed water, which pumps out the waste water via a vacuum line 12 from the washing compartment 10 into a drain water line 6.

The domestic appliance 1 is controlled via a controller 14, especially an electronic controller, which has an electrical control line in each case to the different electrical components of the domestic appliance 1.

If a user puts the domestic appliance 1 into operation using a main switch 16, he connects the controller 14 via a control line 20 to the electrical mains 18. The controller 14 then controls the electrical components of the domestic appliance 1 in accordance with the requirements of an operating program. In this manner the controller 14 can for example activate the drain pump 8 at the end of a washing program for pumping out washing liquor from the compartment 10.

Switched in parallel to main switch 16 is a water safety switch 22. This too can connect the controller 14 to the electrical mains 18. The water safety switch 22 comprises a switching element 24 able to be switched between a first and a second switch position. The first switch position, the operating position, is assigned a first contact or working contact 26, which establishes a connection to the electrical mains 18. The second switch position, the idle position, is assigned a second contact or idle contact 28, which is connected via a second connecting line 32 to the controller 14.

In addition the switching element 24 is connected to the controller 14 via a first connecting line 30 and can be moved to and fro between the working contact 26 and the idle contact 28. In the working position the switching element 24 connects the controller 14 to the electrical mains 18. In the idle position the switching element 24 is in contact with the idle contact 28, so that the first and second connecting line 30, 32 connected to the controller 14 are connected to each other in a type of short circuit. This layout of the safety switch 22 with an idle position in which the lines running in parallel to each other 30, 32 are bridged, thus allows a diagnosis of the switch position of the safety switch 22. However the main switch 16 must be closed for this purpose, i.e. the domestic appliance 1 must be in operation. The controller 14 can additionally activate the signaling facility 34 if the water safety switch 22 is in neither the operating nor the idle position and thereby there is a possible defect of the water safety switch 22.

In order, in the event of an escape of water caused by a fault, to still activate the drain pump 8 with a controller 14 to which no power is supplied via the main switch 16, a float 38 is arranged in a spillage collection trough 36 arranged beneath the washing compartment 10. The float 38 has a mechanical connection 42 to the switching element 24. The float 38 floats upwards as a result of the accumulation of water in the spillage collection trough 36 and moves the switching element 24 into the operating position, i.e. into contact with the working contact 26. By switching on the controller 14 via the water safety switch 22 the latter can switch on the drain pump 8 for pumping out water. The controller 14 also activates a warning device 34 with an acoustic and/or optical warning signal.

If the controller 14 is switched on via the main switch 16, with a water safety switch 22 in its operating position, it can likewise activate the drain pump 8 in accordance with the program for pumping out water that has escaped because of a fault. In addition it can also power off the electromagnetically-controlled inlet valve 40 of the water connection 4 and close it.

As well as a mechanical switching over of switching element 24 into the working position, it is possible according to an embodiment not shown to also switch the water safety switch 22 electrically into the operating position, for which purpose a rechargeable battery is preferably required as an electrical energy source. In addition the float 38 can also be arranged in an overflow area of the washing compartment 10 instead of in the collection trough 36.

In order to switch the water safety switch 22 back from a working position into the idle position after a leak, the switching elements 24 is coupled to a spiral spring not shown in the drawing. It moves the switching element 24 in the direction of the arrow A against the idle contact 28 into the idle position. The small size of the switching element 24 means that only small setting forces are required for this.

List of Reference Signs

1 Domestic appliance
2 Safety device
4 Water connection
6 Waste water line
8 Drain pump
10 Washing compartment
12 Vacuum line
14 Controller
16 Main switch
18 Electrical mains
20 Control line
22 Water safety switch
24 Switching element
26 Working contact
28 Idle contact
30 First connection
32 Second connection
34 Warning device
36 Spillage collection trough
38 Float
40 Inlet valve
42 Mechanical connection

The invention claimed is:

1. A water-conducting domestic appliance, comprising:
a drain pump;
a controller to activate the drain pump; and
a water safety switch having a first switch position to react to an escape of water, the water safety switch connected to the controller and independently controlled by the controller;
wherein, if a fault causes the water to escape, the water safety switch is structured to switch into the first switch position to connect the controller to an electrical mains.

2. The water-conducting domestic appliance of claim 1, wherein the water-conducting domestic appliance is one of a dishwasher and a washing machine.

3. The water-conducting domestic appliance of claim 1, further comprising a main switch, wherein the controller is connected to the main switch to switch the water-conducting domestic appliance at least one of on and off.

4. The water-conducting domestic appliance of claim 3, wherein, when the main switch is switched on, the main switch connects the controller to the electrical mains.

5. The water-conducting domestic appliance of claim 3, wherein a terminal electrically connects the main switch and the water safety switch to the electrical mains.

6. The water-conducting domestic appliance of claim 1, wherein the water safety switch has self-diagnosis capabilities.

7. The water-conducting domestic appliance of claim 6, wherein the water safety switch has a first contact assigned to the first switch position, a second contact assigned to a second switch position, and a switching element to switch the water safety switch between the first switch position and the second switch position; wherein a first connection to the controller is assigned to the switching element; wherein the first contact has a connection to the electrical mains; and wherein a second connection to the controller is assigned the second contact.

8. The water-conducting domestic appliance of claim 1, wherein the water safety switch has reset means to switch a switching element into a second switch position.

9. The water-conducting domestic appliance of claim 8, wherein the reset means is one of a spring and a magnet.

10. The water-conducting domestic appliance of claim 1, further comprising a signaling device that is electrically connected to the controller and that is activated in the first switch position of the water safety switch.

11. The water-conducting domestic appliance of claim 10, wherein the signaling device is one of an acoustic signaling device and an optical signaling device.

12. The water-conducting domestic appliance of claim 1, further comprising a water connection and an electromagnetically-controlled inlet valve arranged at the water connection of the domestic appliance, the electromagnetically-controlled inlet valve electrically connected to the controller and powered off and closed in the first switch position of the water safety switch.

13. A method for controlling a water-conducting domestic appliance, the method comprising:
checking a water safety switch of the water-conducting domestic appliance;
in the event that water escaping from the water-conducting domestic appliance as a result of a fault is detected, controlling the water safety switch in accordance with a program that includes at least one program step in which the water is pumped out; and
wherein the water safety switch is monitored independently of a switch state of the water safety switch.

14. The method of claim 13, wherein the water safety switch is checked for operability one of continuously and at intervals.

15. The method of claim 13, wherein a drain pump of the water-conducting domestic appliance is activated at intervals.

* * * * *